US008568165B2

(12) United States Patent
Wei et al.

(10) Patent No.: US 8,568,165 B2
(45) Date of Patent: Oct. 29, 2013

(54) ELECTRICAL SIGNAL CONNECTOR HAVING A LOCKNUT, CORE TUBE, ELASTIC CYLINDRICAL CASING, AND BARREL FOR QUICK CONNECTION WITH A COAXIAL CABLE

(75) Inventors: Kai-Chih Wei, Taipei (TW); Ming-Feng Chien, Taipei (TW); Michael Holland, Santa Barbara, CA (US)

(73) Assignee: EZCONN Corporation, Taipei (TW)

( * ) Notice: Subject to any disclaimer, the term of this patent is extended or adjusted under 35 U.S.C. 154(b) by 0 days.

(21) Appl. No.: 13/303,239

(22) Filed: Nov. 23, 2011

(65) Prior Publication Data

US 2013/0130541 A1 May 23, 2013

(30) Foreign Application Priority Data

Aug. 25, 2011 (TW) ..... 100215901 U

(51) Int. Cl.
*H01R 9/05* (2006.01)

(52) U.S. Cl.
USPC ..... 439/578

(58) Field of Classification Search
USPC ..... 439/578–585
See application file for complete search history.

(56) References Cited

U.S. PATENT DOCUMENTS

| | | | | |
|---|---|---|---|---|
| 6,929,508 | B1 * | 8/2005 | Holland | 439/579 |
| 7,021,965 | B1 * | 4/2006 | Montena et al. | 439/578 |
| 7,252,546 | B1 * | 8/2007 | Holland et al. | 439/584 |
| 7,255,598 | B2 * | 8/2007 | Montena et al. | 439/578 |
| 7,264,502 | B2 * | 9/2007 | Holland | 439/578 |
| 7,850,487 | B1 * | 12/2010 | Wei | 439/578 |
| 8,137,132 | B2 * | 3/2012 | Lu | 439/578 |

* cited by examiner

*Primary Examiner* — Chandrika Prasad
(74) *Attorney, Agent, or Firm* — Bacon & Thomas, PLLC

(57) ABSTRACT

An electrical connector includes a locknut having an annular locating flange, a core tube for receiving the copper core, inner dielectric insulator and aluminum foil shield of a coaxial cable and supporting the braided metal wrapper and outer plastic sheath of the coaxial cable, a casing surrounding the core tube and having first and second tubular deformable portions and a vertical rear stop edge, and a barrel mounted on the casing between the first tubular deformable portion and the locknut and having a tapered inner surface portion and movable to compress the first and second tubular deformable portions against the coaxial cable and the core tube and an annular front stop edge for stopping a crimping tool used to crimp the casing.

11 Claims, 13 Drawing Sheets

ELECTRICAL SIGNAL CONNECTOR HAVING A LOCKNUT, CORE TUBE, ELASTIC CYLINDRICAL CASING, AND BARREL FOR QUICK CONNECTION WITH A COAXIAL CABLE

This application claims the priority benefit of Taiwan patent application number 100215901 file on Aug. 25, 2011.

BACKGROUND OF THE INVENTION

1. Field of the Invention

The present invention relates electrical connectors and more particularly to an electrical signal connector consisting of a metal locknut, a core tube, an elastic cylindrical casing and a barrel for quick connection with a coaxial cable by means of moving the barrel relative to the cylindrical casing to deform the cylindrical casing without causing damage to the coaxial cable.

2. Description of the Related Art

Following fast development of electronic and multimedia technology, advanced TV, audio system, video player, digital camera, video game machine and may other electronic products have been continuously created to serve people. Due to critical requirements from consumers, signal transmission requires high stability and rapid speed. To achieve high performance, high quality audio and video equipment must be used with high quality signal lines and signal connectors.

Subject to the application of telephone technology, video technology and internet technology, global communication becomes faster and cheaper. Transmission of video signal through a cable assures signal stability and reliability. Therefore, CATV (closed-circuit TV) is developed after the application of wireless TV and satellite TV. A CATV is adapted for providing television programs to consumers via RF signals transmitted to televisions through coaxial cables or digital light pulses through fixed optical fibers located on the subscriber's unit. Establishing a closed-circuit television system requires installation of cables between the provider and the subscribers. When a cable is extended to a house, an electrical signal connector must be used to connect the cable to an indoor electric or electronic device. During installation, the size, specification and impedance (for example, 75 Ohm) of the connector must match with the cable. After insertion of the cable into the connector, a crimping tool shall be used to crimp the connector, enhancing connection stability and protecting the connection against external water or impurities.

FIGS. 12 and 13 illustrate a conventional electrical signal connector A for this purpose. As illustrated, the electrical signal connector A comprises a locknut A1, an outer tubular member A3 connected to the locknut A, an inner tubular member A2 mounted in the outer tubular member A3, a barrel A4 slidably coupled to the outer tubular member A3. During installation, the center conductor B1, inner dielectric insulator B2 and aluminum foil shield B3 of the coaxial cable B are inserted into the outer tubular member A3 and then into the axial hole A20 of the inner tubular member A2 to have the braided metal wrapper (woven copper shield) B4 and outer plastic sheath B5 of the coaxial cable B be sleeved onto the inner tubular member A2 within the outer tubular member A3, and then a crimping tool is operated to move the barrel A4 relative to the outer tubular member A3 and to compress outer tubular member A3 and to force a barbed portion A31 of the outer tubular member A3 into engagement with the braided metal wrapper (woven copper shield) B4 and outer plastic sheath B5 of the coaxial cable B against the inner tubular member A2. Thus, the electrical signal connector A and the coaxial cable B are fixedly fastened together. According to this design, the barrel A4 has simply a part of the inner wall kept in contact with the outer tubular member A3. When moving the barrel A4 relative to the outer tubular member A3, the outer tubular member A3 may be biased relative to the coaxial cable B, and the barbed portion A31 of the outer tubular member A3 may be not positively forced into engagement with the braided metal wrapper (woven copper shield) B4 and outer plastic sheath B5 of the coaxial cable B against the inner tubular member A2.

Further, it is necessary to insert the coaxial cable B trough the barrel A4 before inserting the coaxial cable B into the axial hole A20 of the inner tubular member A2. After insertion of the center conductor B1, inner dielectric insulator B2 and aluminum foil shield B3 of the coaxial cable B into the axial hole A20 of the inner tubular member A2, the barrel A4 can then be attached to the outer tubular member A3 and then moved relative to the outer tubular member A3 and to compress outer tubular member A3 and to force a barbed portion A31 of the outer tubular member A3 into engagement with the braided metal wrapper (woven copper shield) B4 and outer plastic sheath B5 of the coaxial cable B against the inner tubular member A2. This installation procedure is complicated, requiring much effort. Further, if the outer tubular member A3 is biased relative to the coaxial cable B and the barbed portion A31 of the outer tubular member A3 is not positively forced into engagement with the braided metal wrapper (woven copper shield) B4 and outer plastic sheath B5 of the coaxial cable B against the inner tubular member A2, the signal transmission quality will be affected.

Therefore, it is desirable to provide an electrical signal connector, which eliminates the aforesaid drawbacks and facilitates quick and accurate installation, assuring a high level of signal transmission quality.

SUMMARY OF THE INVENTION

The present invention has been accomplished under the circumstances in view. It is the main object of the present invention to provide an electrical signal connector, which facilitates quick and accurate installation, avoiding component damage and assuring installation alignment accuracy and avoiding the use of any extra parts.

To achieve this and other objects of the present invention, an electrical signal connector comprises a locknut made of metal, a core tube, a cylindrical casing and a barrel. The locknut comprises opposing front and rear sides and an annular locating flange located on the front side thereof. The core tube comprises an axial hole axially extending through opposing front and rear sides thereof for receiving a copper core (center conductor), an inner dielectric insulator and an aluminum foil shield of a coaxial cable, and a first tubular wall and a second tubular wall axially connected in series around the axial hole of the core tube for supporting a braided metal wrapper (woven copper shield) and an outer plastic sheath of the coaxial cable. The cylindrical casing surrounds the core tube, comprising an axial hole for receiving the core tube, a first tubular deformable portion and a second tubular deformable portion axially connected in series around the axial hole of the cylindrical casing, and a vertical rear stop edge located on the rear end of the second tubular deformable portion remote from the first tubular deformable portion. The barrel is axially movably mounted on the cylindrical casing between the first tubular deformable portion and the locknut, comprising a tapered inner surface portion located on the rear side thereof and movable with the barrel over the first tubular deformable portion and the second tubular deformable portion of the cylindrical casing to compress the first tubular deformable portion and the second tubular deformable portion against the inserted coaxial cable and the core tube, and an annular front stop edge perpendicularly located on the front side thereof for stopping a crimping tool that is used to crimp the cylindrical casing.

As the barrel is sleeved onto the cylindrical casing and kept between the first tubular deformable portion of the cylindrical casing and the locknut, moving the barrel toward the first tubular deformable portion of the cylindrical casing does not bias the barrel relative to the cylindrical casing, assuring alignment accuracy and avoiding the use of any extra parts.

Further, when forcing the tapered inner surface portion of the barrel against the tapered abutment face of the cylindrical casing during installation, the outside annular flange and second tubular deformable portion of the cylindrical casing are evenly compressed to deform and to squeeze the braided metal wrapper (woven copper shield) and outer plastic sheath of the coaxial cable against the second tubular wall and barbed flange of the core tube, causing the barbed flange of the core tube to be engaged into the braided metal wrapper of the coaxial cable. Thus, the coaxial cable and the electrical signal connector can be firmly secured together with less effort, avoiding damage to the copper core of the coaxial cable or loosening of the coaxial cable, and assuring signal transmission stability.

DETAILED DESCRIPTION OF THE PREFERRED EMBODIMENT

Figure 1:
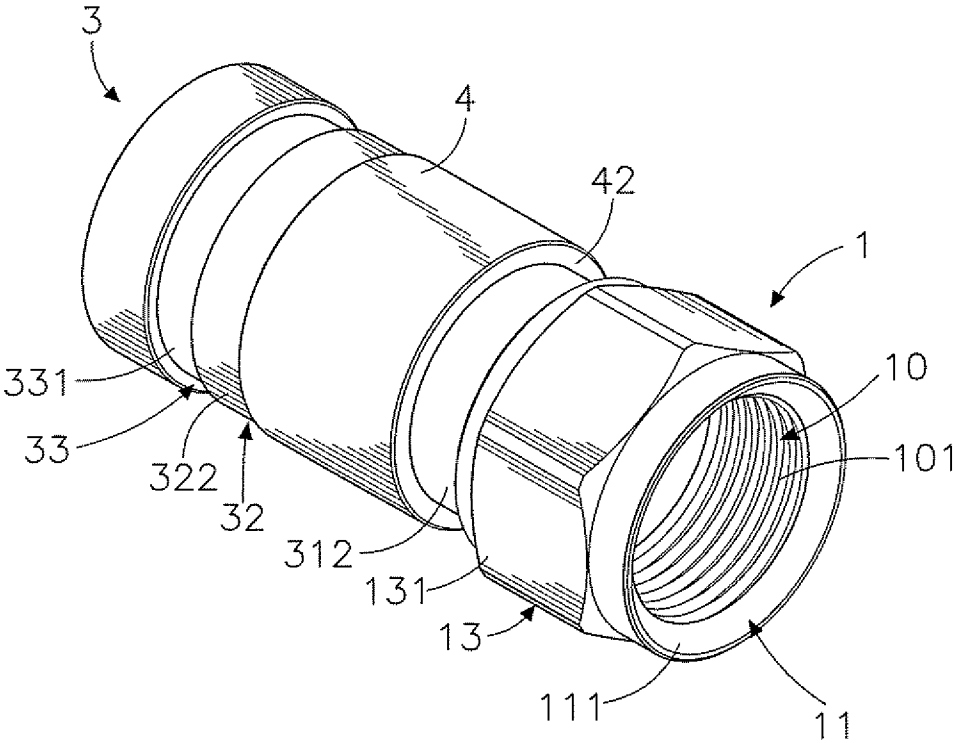
FIG. 1 is an elevational view of an electrical signal connector in accordance with the present invention.
Figure 2:
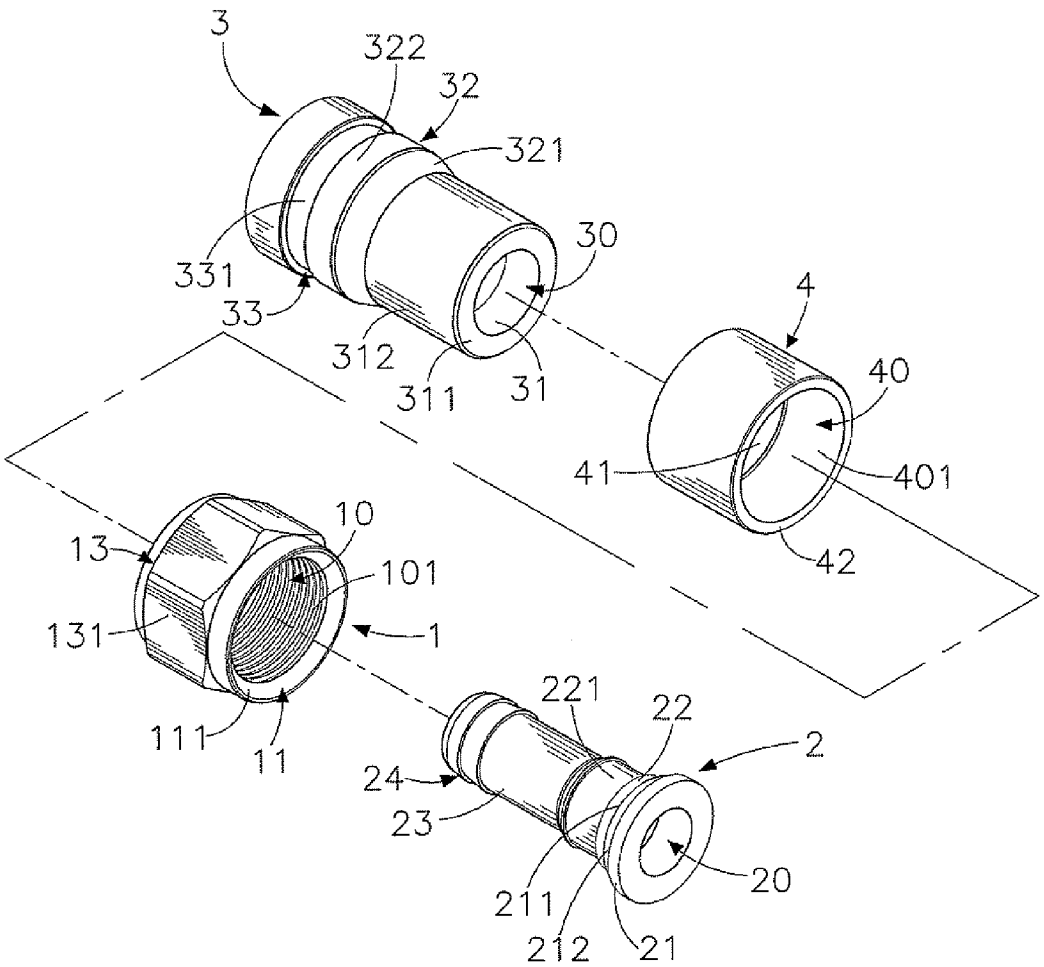
FIG. 2 is an exploded view of the electrical signal connector in accordance with the present invention.
Figure 3:
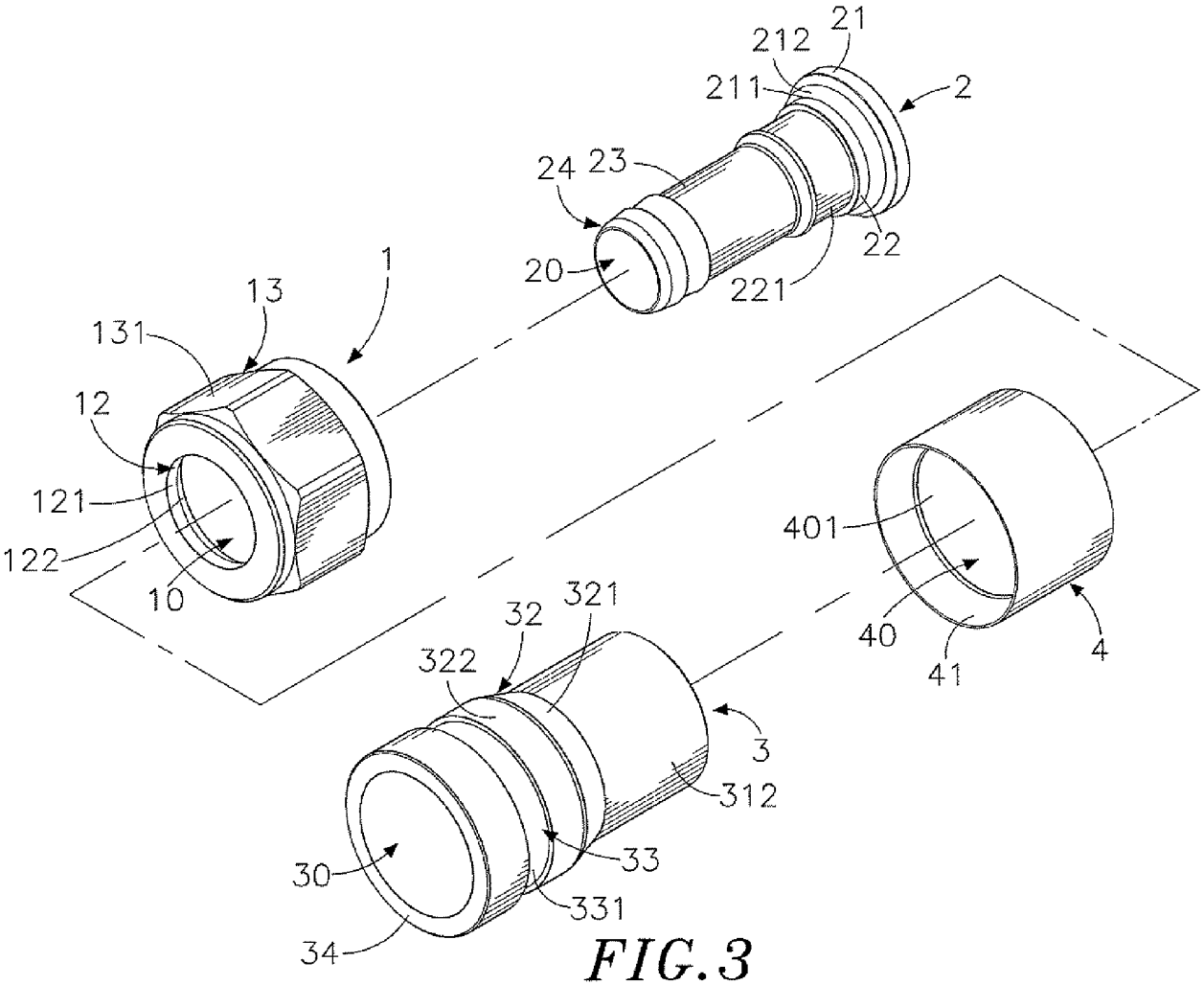
FIG. 3 corresponds to FIG. 2 when viewed from another angle.
Figure 4:
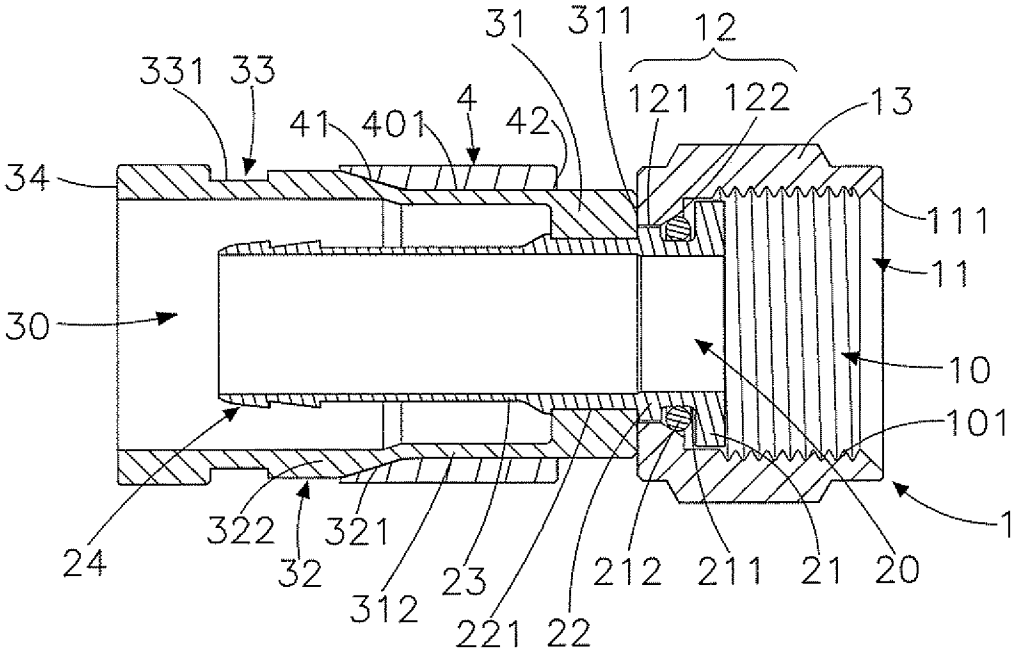
FIG. 4 is a sectional side view of the electrical signal connector in accordance with the present invention.

Referring to FIGS. 1~4, an electrical signal connector in accordance with the present invention is shown comprising a locknut 1, a core tube 2, a cylindrical casing 3 and a barrel 4.

The locknut 1 is a metal member shaped like a polygonal screw nut, comprising a center hole 10 axially extending through opposing front and rear sides thereof, an inner thread 101 extending around the inside wall thereof within the center hole 10, an annular locating flange 11 located on the front side thereof and defining therein an orifice 111 in communication with one end of the center hole 10, a retaining portion 12 located on the rear side thereof around the center hole 10, and an operating portion 13 formed of a hexagonal wall 131 and disposed around the center hole 10 between the annular locating flange 11 and the retaining portion 12. The retaining portion 12 comprises a stepped shoulder 121 extending around the other end of the center hole 10 and a beveled abutment face 122 located on the outer side of the stepped shoulder 121.

The core tube 2 comprises an axial hole 20 axially extending through opposing front and rear sides thereof, a stop flange 21 extending around the periphery of the front side thereof, a barbed flange 24 extending around the periphery of the rear side thereof, a first tubular wall 221 and a second tubular wall 23 axially connected in series between the stop flange 21 and the barbed flange 24 around the axial hole 20 in a stepped manner, a packing portion 22 connected between the stop flange 21 and the first tubular wall 221 around the axial hole 20, an outside annular groove 211 located on the periphery between the stop flange 21 and the packing portion 22 and around the axial hole 20, and a gasket ring 212 mounted around the outside annular groove 211.

The cylindrical casing 3 is made of an elastically deformable plastic material, comprising a tubular body 312, an axial hole 30 surrounded by the tubular body 312, an annular flange 31 located on one end, namely, the front end of the tubular body 312 and defining a vertical front stop edge 311, a first tubular deformable portion 32 and a second tubular deformable portion 33 axially connected in series around the axial hole 30 and extended from the other end, namely, the rear end of the tubular body 312, and a vertical rear stop edge 34 located on one end, namely the rear end of the second tubular deformable portion 33 opposite to the first tubular deformable portion 32, a tapered abutment face 321 formed of a part of the first tubular deformable portion 32 and sloping downwardly forwardly from the first tubular deformable portion 32 toward the tubular body 312, an outside annular flange 322 formed of a part of the first tubular deformable portion 32 and connected between the tapered abutment face 321 and the second tubular deformable portion 33, and a locating groove 331 extending around the periphery of the second tubular deformable portion 33.

The barrel 4 comprises a receiving hole 40 axially extending through opposing front and rear sides thereof, a tapered inner surface portion 41 located on the rear side thereof and having an inner diameter that increases gradually outwardly from the receiving hole 40 toward the rear side of the barrel 4, and an annular front stop edge 42 perpendicularly located on the front side thereof around the receiving hole 40.

During installation, insert the core tube 2 through the orifice 111 in the annular locating flange 11 of the locknut 1 into the center hole 10 of the locknut 1 to abut the stop flange 21 of the core tube 2 against the retaining portion 12 of the locknut 1. At this time, the stepped shoulder 121 and the beveled abutment face 122 of the retaining portion 12 of the locknut 1 are forced against the gasket ring 212 at the outside annular groove 211 of the core tube 2. Thus, the locknut 1 effectively prohibits permeation of outside water after installation of the electrical signal connector in a coaxial cable and connection of the electrical signal connector to a signal distributor.

After connection between the locknut 1 and the core tube 2, insert the core tube 2 into the axial hole 30 of the cylindrical casing 3 to press-fit the annular flange 31 of the cylindrical casing 3 onto the first tubular wall 221 of the core tube 2 and to simultaneously stop the vertical front stop edge 311 of the annular flange 31 against the retaining portion 12 of the locknut 1. At this time, the retaining portion 12 of the locknut 1 is positioned in the space between the annular flange 31 of the cylindrical casing 3 and the stop flange 21 of the core tube 2 to prohibit falling of the locknut 1 out of the core tube 2, and the second tubular wall 23 and barbed flange 24 of the core tube 2 suspend in the axial hole 30 of the cylindrical casing 3. Thereafter, attach the barrel 4 to the cylindrical casing 3 to have the tubular body 312 of the cylindrical casing 3 be received in the receiving hole 40 of the barrel 4 and kept in contact with the inside wall 401 of the barrel 4, allowing axial movement of the barrel 4 along the tubular body 312 of the cylindrical casing 3.

Figure 5:
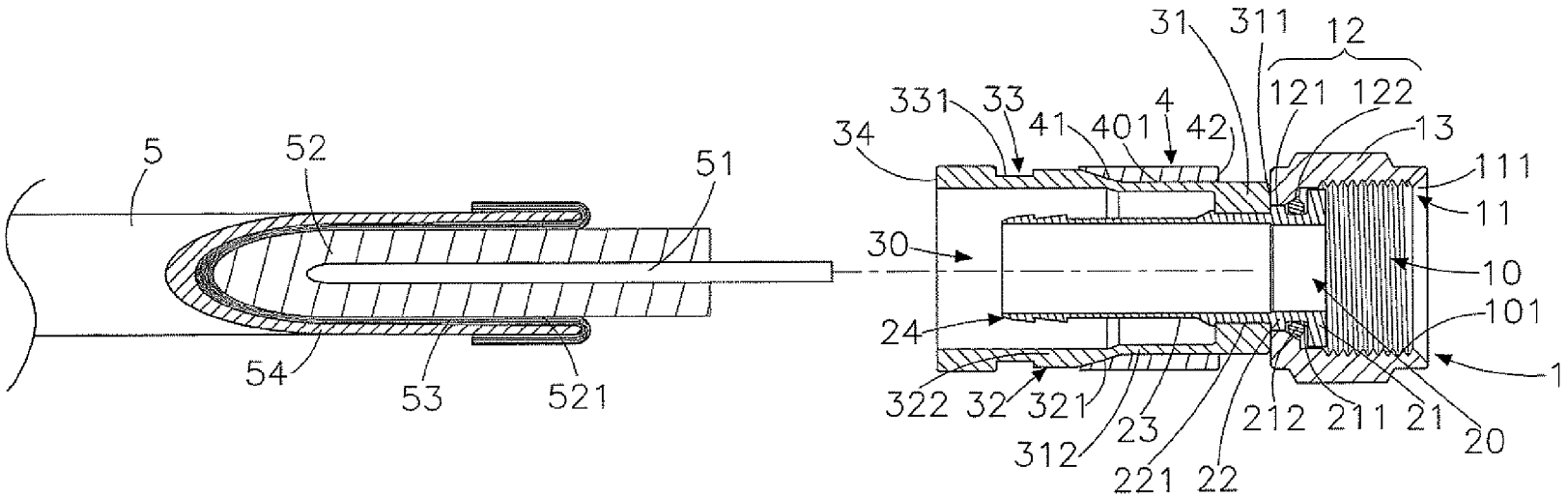
FIG. 5 is a schematic installed view of the present invention, illustrating connection between the electrical signal connector and a coaxial cable (I).
Figure 6:
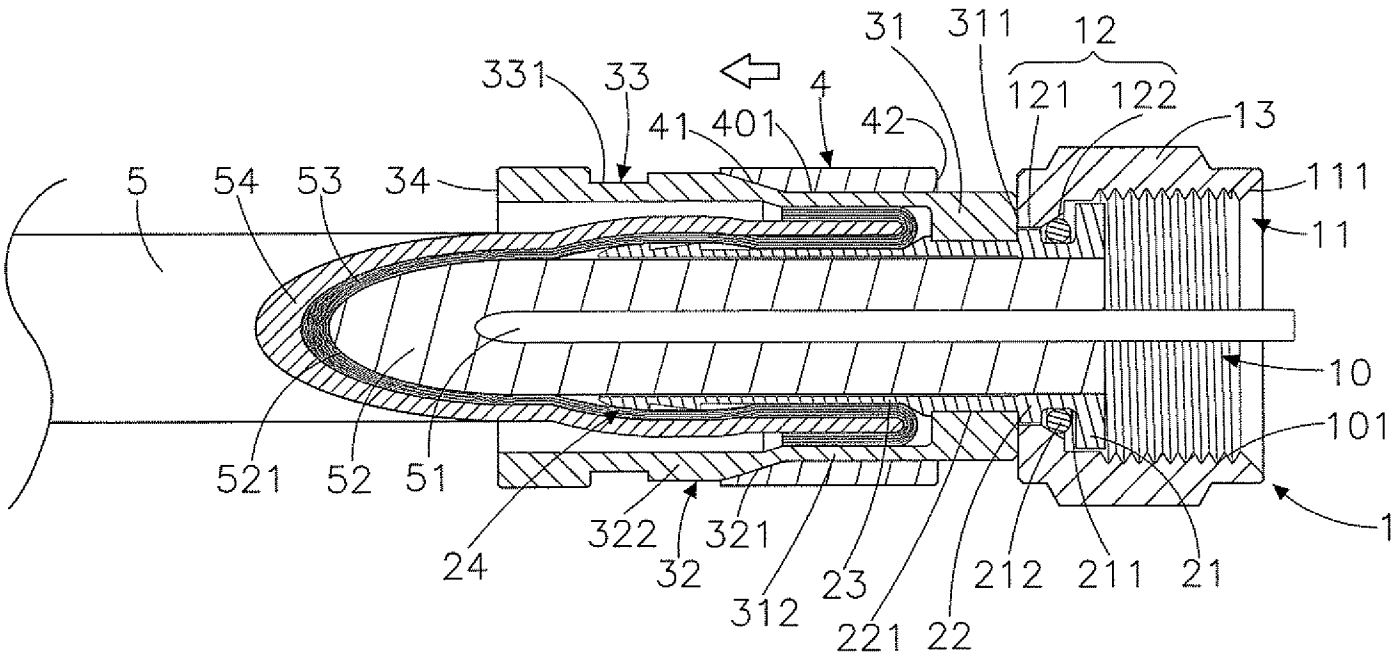
FIG. 6 is a schematic installed view of the present invention, illustrating connection between the electrical signal connector and the coaxial cable (II).
Figure 7:
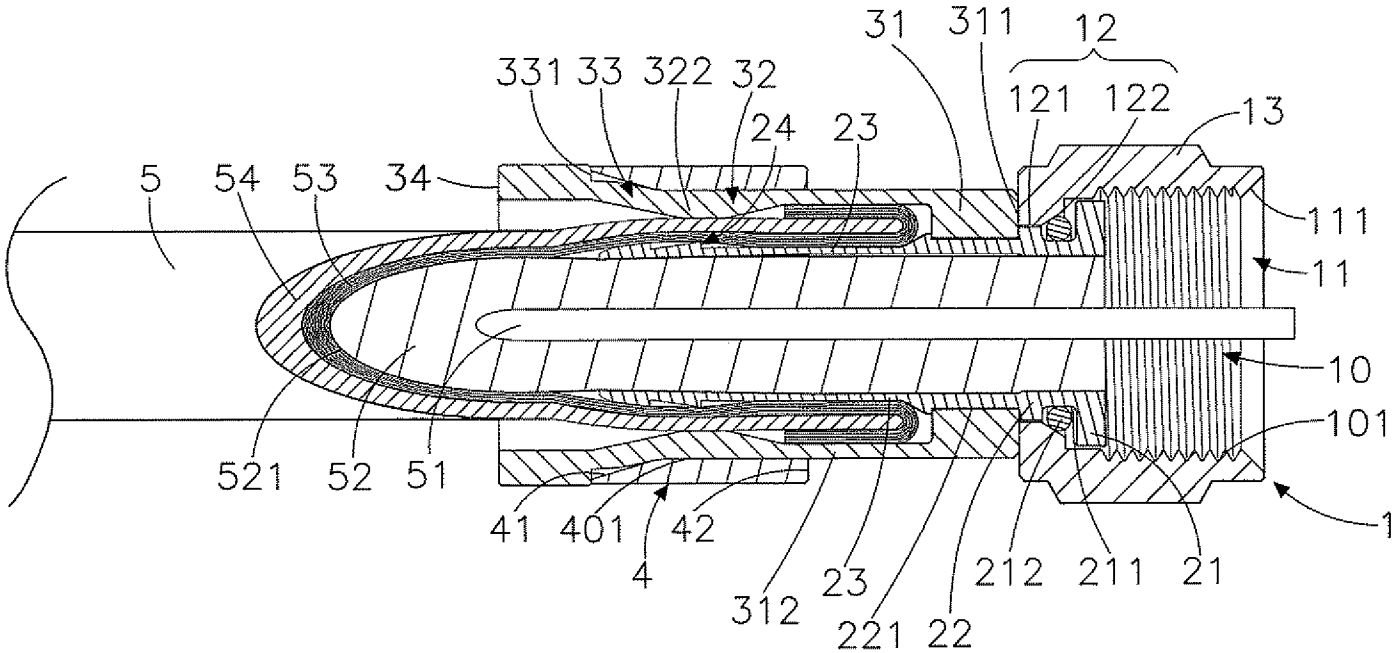
FIG. 7 is a schematic installed view of the present invention, illustrating connection between the electrical signal connector and the coaxial cable (III).

Referring to FIGS. 5~7 and FIGS. 2 and 4 again, the electrical signal connector of the invention is to be used with a coaxial cable 5 that comprises an outer plastic sheath 54, a braided metal wrapper (woven copper shield) 53 surrounded by the outer plastic sheath 54, an inner dielectric insulator 52 surrounded by the braided metal wrapper (woven copper shield) 53, an aluminum foil shield (or mylar tape) 521 surrounding the inner dielectric insulator 52 and surrounded by the braided metal wrapper (woven copper shield) 53, and a copper core (center conductor) 51 surrounded by the inner dielectric insulator 52. When fastening the electrical signal connector to the coaxial cable 5, insert the copper core (center conductor) 51, inner dielectric insulator 52 and aluminum foil shield (or mylar tape) 521 of the coaxial cable 5 into the axial hole 20 of the core tube 2 in the axial hole 30 of the cylindrical casing 3 manually by hand to have the braided metal wrapper (woven copper shield) 53 and outer plastic sheath 54 of the coaxial cable 5 be sleeved onto the second tubular wall 23 and barbed flange 24 of the core tube 2. When pushing the coaxial cable 5 forwardly relative to the electrical signal connector to the position where the end edge of the inner dielectric insulator 52 is kept in flush with the front side of the core tube 2, the copper core (center conductor) 51 of the coaxial cable 5 is kept suspending out of the orifice 111 of the annular locating flange 11 of the locknut 1.

Thereafter, use a hand crimper to crimp the cylindrical casing 3 against the coaxial cable 5. It is to be understood that an automatic machine or implement may be used to crimp the electrical signal connector and the coaxial cable 5 together. When a hand crimper is used, the two crimping jaws of the hand crimper are respectively attached to the annular flange 31 of the cylindrical casing 3 and a part of the coaxial cable 5 outside the cylindrical casing 3, keeping a part of one crimping jaw be stopped against the vertical rear stop edge 34 of the cylindrical casing 3 and a part of the other crimping jaw be stopped against the annular front stop edge 42 of the barrel 4. At this time, apply a pressure to the hand crimper to move the barrel 4 toward the first tubular deformable portion 32 of the cylindrical casing 3 and to force the tapered inner surface portion 41 of the barrel 4 against the tapered abutment face 321 of the cylindrical casing 3. In this embodiment, the inner surface portion 41 of the barrel 4 is tapered. Alternatively, the inner surface portion 41 of the barrel 4 can be designed having a beveled, curved, stepped or vertical configuration. As the barrel 4 is sleeved onto the cylindrical casing 3 and kept between the first tubular deformable portion 32 of the cylindrical casing 3 and the locknut 1, moving the barrel 4 toward the first tubular deformable portion 32 of the cylindrical casing 3 does not bias the barrel 4 relative to the cylindrical casing 3, assuring alignment accuracy and avoiding the use of any extra parts. When forcing the tapered inner surface portion 41 of the barrel 4 against the tapered abutment face 321 of the cylindrical casing 3 during installation, the outside annular flange 322 and second tubular deformable portion 33 of the cylindrical casing 3 are evenly compressed to deform and to squeeze the braided metal wrapper (woven copper shield) 53 and outer plastic sheath 54 of the coaxial cable 5 against the second tubular wall 23 and the barbed flange 24 of the core tube 2, causing the barbed flange 24 of the core tube 2 to be engaged into the braided metal wrapper (woven copper shield) 53 of the coaxial cable 5. Thus, the coaxial cable 5 and the electrical signal connector are firmly secured together. This installation procedure requires less effort, avoiding damage to the copper core (center conductor) 51 of the coaxial cable 5 or loosening of the coaxial cable 5, and assuring signal transmission stability.

Further, when moving the inside wall 401 of the barrel 4, along the tubular body 312 of the cylindrical casing 3, the tapered inner surface portion 41 of the barrel 4 will be moved over the first tubular deformable portion 32 of the cylindrical casing 3 to the locating groove 331 at the second tubular deformable portion 33 to compress the first tubular deformable portion 32 and the second tubular deformable portion 33, thereby flattening the first tubular deformable portion 32. Thus, the barrel 4 will be firmly secured to the cylindrical casing 3 when the tapered inner surface portion 41 of the barrel 4 reaches the locating groove 331 of the second tubular deformable portion 33.

Figure 8:
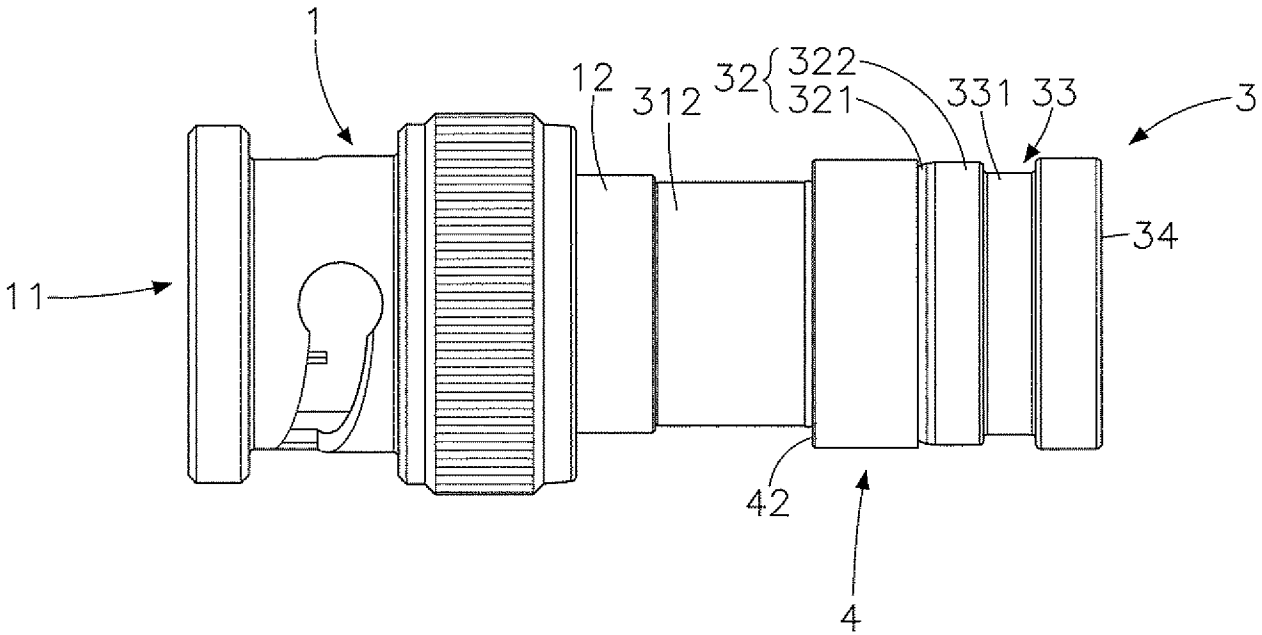
FIG. 8 is a schematic side view of an alternate form of the electrical signal connector in accordance with the present invention.
Figure 9:
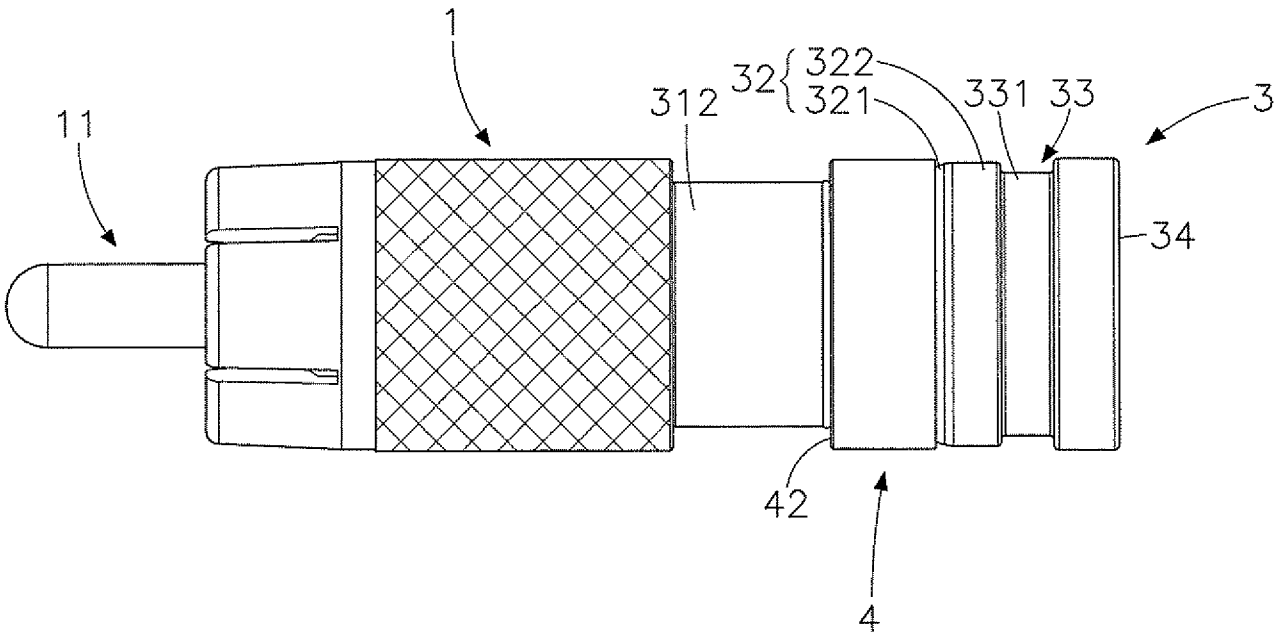
FIG. 9 is a schematic side view of another alternate form of the electrical signal connector in accordance with the present invention.
Figure 10:
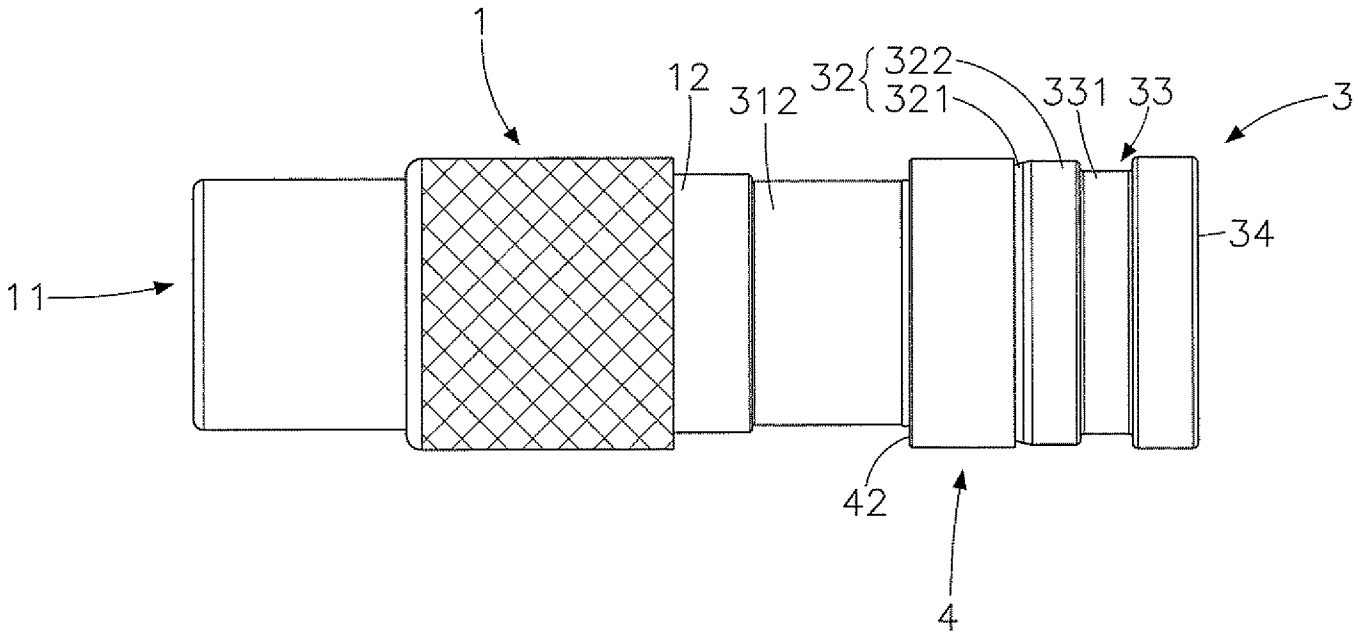
FIG. 10 is a schematic side view of still another alternate form of the electrical signal connector in accordance with the present invention.
Figure 11:
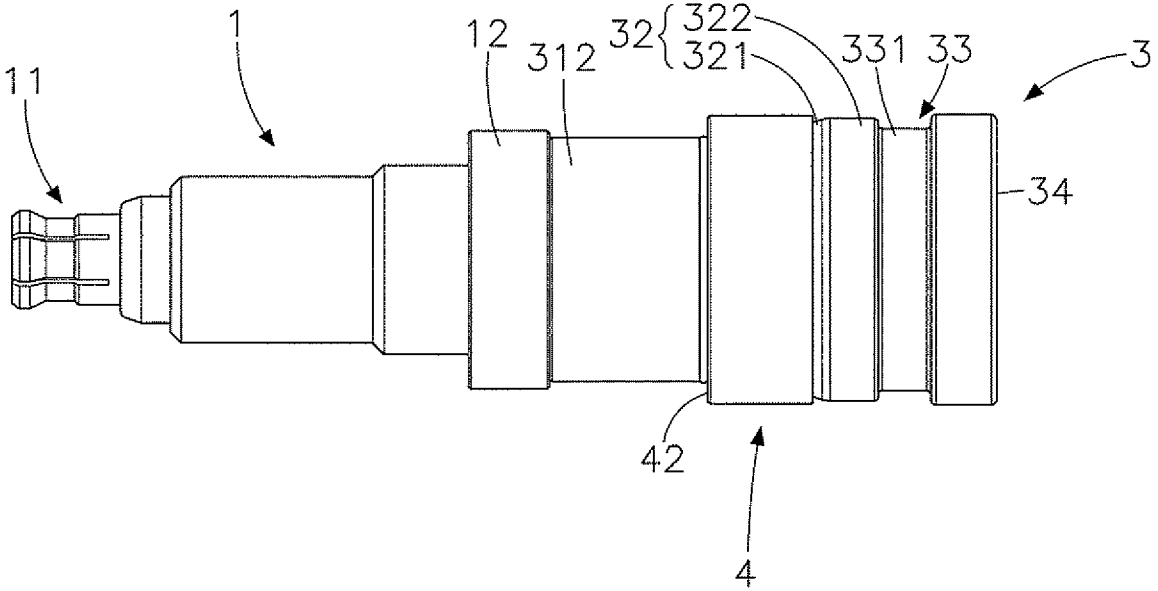
FIG. 11 is a schematic side view of still another alternate form of the electrical signal connector in accordance with the present invention.
Figure 12:
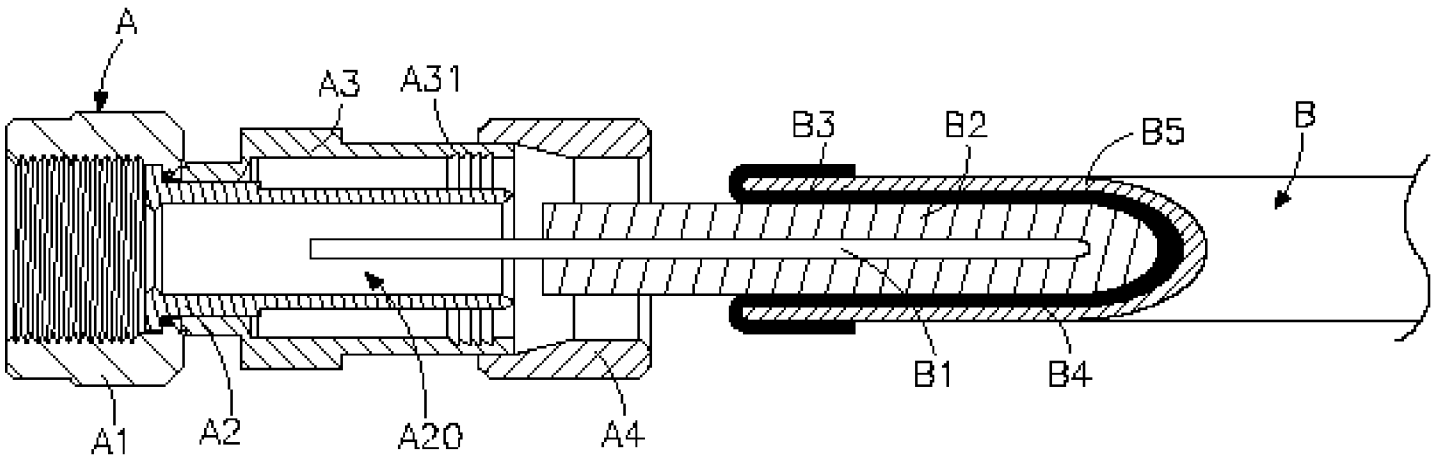
PRIOR ART FIG. 12
FIG. 12 is a sectional side view illustrating installation of an electrical signal connector in a coaxial cable according to the prior art.
Figure 13:
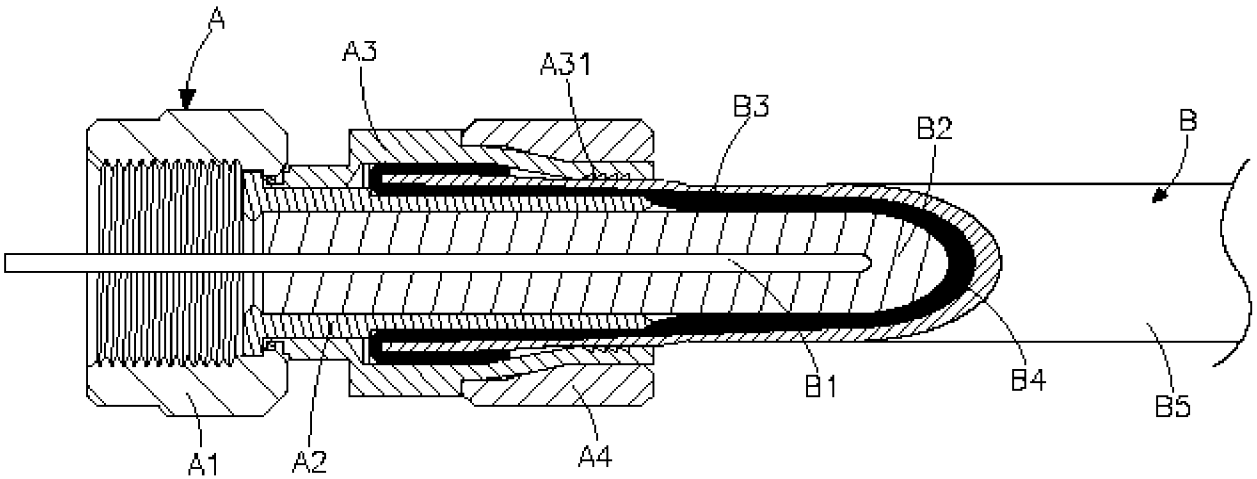
PRIOR ART FIG. 13
FIG. 13 corresponds to FIG. 8, illustrating the electrical signal connector and the coaxial cable fastened together.

Referring to FIGS. 2 and 5 again, as stated above, the stop flange 21 and the packing portion 22 of the core tube 2 are positioned in the rear side of the locknut 1 remote from the annular locating flange 11 and surrounded by the cylindrical casing 3, the second tubular wall 23 and the barbed flange 24 of the core tube 2 suspend in the axial hole 30 of the cylindrical casing 3 for receiving the coaxial cable 5; the barrel 4 is sleeved onto the cylindrical casing 3 with the tapered inner surface portion 41 abutted against the tapered abutment face 321 of the first tubular deformable portion 32. After insertion of the coaxial cable 5 into the core tube 2 and the cylindrical casing 3, the barrel 4 is moved axially relative to the cylindrical casing 3 to force the tapered inner surface portion 41 over the first tubular deformable portion 32 of the cylindrical casing 3 to the locating groove 331 at the second tubular deformable portion 33, thereby compressing the first tubular deformable portion 32 and the second tubular deformable portion 33 and tightening up engagement between the coaxial cable 5 and the core tube 2. Further, the locknut 1 and the core tube 2 can be configured subject any of a variety of different specifications. In the embodiment shown in FIG. 1, the annular locating flange 11 of the locknut 1 is an F connector. Alternatively, the annular locating flange 11 of the locknut 1 can be configured subject to BNC (Bayonet Neill-Concelman) connector specification (see FIG. 8), RCA (Radio Corporation of America) connector specification (see FIG. 9), IEC (International Electrical Commission) connector specification (see FIG. 10), MCX/MCXX connector specification (see FIG. 11).

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical connector, comprising:

a locknut made of metal, said locknut comprising opposing front and rear sides and an annular locating flange located on the front side thereof;

a core tube, said core tube comprising an axial hole axially extending through opposing front and rear sides thereof for receiving a copper core (center conductor) and an inner dielectric insulator of a coaxial cable, and a first tubular wall and a second tubular wall axially connected in series around the axial hole of said core tube for supporting a braided metal wrapper (woven copper shield) and an outer plastic sheath of said coaxial cable;

a cylindrical casing surrounding said core tube, said cylindrical casing being elastically deformable, said cylindrical casing comprising an axial hole for receiving said core tube, a first tubular deformable portion and a second tubular deformable portion axially connected in series around the axial hole of said cylindrical casing, and a vertical rear stop edge located on a rear end of said second tubular deformable portion remote from said first tubular deformable portion; and a barrel axially movably mounted on said cylindrical casing between said first tubular deformable portion and said locknut, said barrel comprising a tapered inner surface portion located on a rear side thereof and movable with said barrel over said first tubular deformable portion and said second tubular deformable portion of said cylindrical casing to compress said first tubular deformable portion and said second tubular deformable portion against the inserted coaxial cable and said core tube, and an annular front stop edge located on a front side thereof.

2. The electrical signal connector as claimed in claim 1, wherein said locknut further comprises an inner thread extending around an inside wall thereof, an orifice defined in said annular locating flange, and an operating portion formed of a hexagonal wall.

3. The electrical signal connector as claimed in claim 1, wherein said locknut further comprises a retaining portion located on the rear side thereof; said core tube further comprises a stop flange extending around the periphery of the front side thereof and stopped against said retaining portion of said locknut, a first tubular wall and a second tubular wall axially extended from said stop flange and a packing portion connected between said stop flange and said first tubular wall; said cylindrical casing further comprises an annular flange attached to said packing portion of said core tube.

4. The electrical signal connector as claimed in claim 3, wherein said retaining portion of said locknut comprises a stepped shoulder and a beveled abutment face located on an outer side of said stepped shoulder.

5. The electrical signal connector as claimed in claim 1, wherein said annular locating flange of said locknut is configured subject to one of the specifications of F connector, BNC connector, RCA connector, IEC connector, micro coaxial connector and micro RF coaxial connector.

6. The electrical signal connector as claimed in claim 1, wherein said cylindrical casing further comprises an annular flange 10 positioned in said first tubular wall of said core tube, and a vertical front stop edge located on said annular flange and stopped against said locknut.

7. The electrical signal connector as claimed in claim 6, wherein said core tube further comprises a barbed flange located on the rear side thereof for engaging the coaxial cable.

8. The electrical signal connector as claimed in claim 1, wherein said cylindrical casing further comprises a tubular body for supporting said barrel, a tapered abutment face formed of a part of said first tubular deformable portion and sloping downwardly 20 forwardly from said first tubular deformable portion toward said tubular body, and an outside annular flange formed of a part of said first tubular deformable portion and connected between said tapered abutment face and said second tubular deformable portion.

9. The electrical signal connector as claimed in claim 1, wherein said cylindrical casing further comprises a locating groove extending around the periphery of said second tubular deformable portion and adapted for receiving said tapered inner surface portion of said barrel.

10. The electrical signal connector as claimed in claim 1, wherein said cylindrical casing further is made of an elastically deformable plastic material.

11. The electrical signal connector as claimed in claim 1, wherein said barrel further comprises a receiving hole axially extending through the opposing front and rear sides thereof and attached to said cylindrical casing; said tapered inner surface portion of said barrel extends radially outwardly from a rear end of said receiving hole to the rear side of said cylindrical casing.

* * * * *